US006855043B1

(12) United States Patent
Tang et al.

(10) Patent No.: US 6,855,043 B1
(45) Date of Patent: Feb. 15, 2005

(54) CARRIER HEAD WITH A MODIFIED FLEXIBLE MEMBRANE

(75) Inventors: Jianshe Tang, Cupertino, CA (US); Brian J. Brown, Palo Alto, CA (US); Charles C. Garretson, Palo Alto, CA (US); Benjamin A. Bonner, San Mateo, CA (US); Thomas H. Osterheld, Mountain View, CA (US); Fred C. Redeker, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/611,247

(22) Filed: Jul. 7, 2000

Related U.S. Application Data

(60) Provisional application No. 60/143,207, filed on Jul. 9, 1999.

(51) Int. Cl.[7] ..... B24B 47/02

(52) U.S. Cl. ..... 451/398; 451/288; 451/290

(58) Field of Search ..... 451/28, 56, 285, 451/286, 287, 288, 289, 290, 397, 398

(56) References Cited

U.S. PATENT DOCUMENTS

| | | | | |
|---|---|---|---|---|
| 3,654,047 A | | 4/1972 | Berkowitz | |
| 4,132,037 A | * | 1/1979 | Bonora | 451/288 |
| 4,319,432 A | | 3/1982 | Day | |
| 4,512,113 A | * | 4/1985 | Budinger | |
| 4,834,382 A | * | 5/1989 | Spector | 473/603 |
| 4,918,869 A | | 4/1990 | Kitta | |
| 5,193,316 A | | 3/1993 | Olmstead | |
| 5,205,082 A | | 4/1993 | Shendon et al. | |
| 5,423,716 A | | 6/1995 | Strasbaugh | |
| 5,449,316 A | | 9/1995 | Strasbaugh | |
| 5,486,129 A | * | 1/1996 | Sandhu et al. | 451/5 |
| 5,584,751 A | | 12/1996 | Kobayashi et al. | |
| 5,624,299 A | | 4/1997 | Shendon | |
| 5,643,053 A | | 7/1997 | Shendon | |
| 5,643,061 A | | 7/1997 | Jackson et al. | |
| 5,759,918 A | | 6/1998 | Hoshizaki et al. | |
| 5,803,799 A | | 9/1998 | Volodarsky et al. | |
| 5,830,806 A | * | 11/1998 | Hudson et al. | 451/287 |
| 5,851,140 A | | 12/1998 | Barns et al. | |
| 5,879,220 A | | 3/1999 | Hasegawa et al. | |
| 5,957,751 A | | 9/1999 | Govzman et al. | |
| 5,964,653 A | | 10/1999 | Perlov et al. | |
| 6,024,630 A | * | 2/2000 | Shendon et al. | 451/41 |
| 6,068,549 A | * | 5/2000 | Jackson | 451/398 |
| 6,080,050 A | | 6/2000 | Chen et al. | |
| 6,132,298 A | | 10/2000 | Zuniga et al. | |
| 6,146,259 A | | 11/2000 | Zuniga et al. | |
| 6,159,079 A | | 12/2000 | Zuniga et al. | |
| 6,162,116 A | | 12/2000 | Zuniga et al. | |
| 6,165,058 A | | 12/2000 | Zuniga et al. | |
| 6,183,354 B1 | | 2/2001 | Zuniga et al. | |
| 6,210,255 B1 | | 4/2001 | Zuniga et al. | |
| 6,227,955 B1 | * | 5/2001 | Custer et al. | 451/285 |
| 6,290,584 B1 | * | 9/2001 | Kim et al. | 451/288 |

FOREIGN PATENT DOCUMENTS

| | | |
|---|---|---|
| EP | 0 774 323 | 5/1997 |
| EP | 0 841 123 | 5/1998 |
| JP | 54-115682 | 8/1979 |
| JP | 2243263 | 9/1990 |
| WO | WO 99/07516 | 2/1999 |

* cited by examiner

*Primary Examiner*—Timothy V. Eley
(74) *Attorney, Agent, or Firm*—Fish & Richardson

(57) ABSTRACT

A carrier head for a chemical mechanical polishing apparatus includes a flexible membrane that applies a load to a substrate and a retaining ring. The friction coefficient of the lower surface of the flexible membrane is increased to prevent contact between the substrate and the retaining ring, thereby preventing slurry compaction and buildup and substrate deformation caused by such contact.

4 Claims, 2 Drawing Sheets

CARRIER HEAD WITH A MODIFIED FLEXIBLE MEMBRANE

CROSS-REFERENCE TO RELATED APPLICATIONS

The present application claims priority to Provisional U.S. Application Ser. No. 60/143,207, filed Jul. 9, 1999.

BACKGROUND

This invention relates to chemical mechanical polishing, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface can present problems in the photolithographic steps of the integrated circuit fabrication process. Therefore, there is a need to periodically planarize the substrate surface. In addition, planarization is needed when polishing back a filler layer, e.g., when filling trenches in a dielectric layer with metal.

Chemical mechanical polishing (CMP) is one accepted method of planarization. This planarization method typically requires that the substrate be mounted on a carrier or polishing head. The exposed surface of the substrate is placed against a polishing pad, such as circular pad or linear belt, that moves relative to the substrate. The polishing pad may be either a "standard" or a fixed-abrasive pad. A standard polishing pad has a durable roughened or soft surface, whereas a fixed-abrasive pad has abrasive particles held in a containment media. The carrier head provides a controllable load on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-active agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is non-uniform polishing, i.e., variation in the polishing rate across the substrate surface, resulting in non-uniform substrate thickness. One cause of non-uniform polishing is substrate deformation, e.g., bowing of the substrate.

Another problem with CMP is that it is a "dirty" process. Specifically, foreign material is introduced while the polishing process is performed. However, this foreign material needs to be removed before the substrate is further processed to prevent substrate contamination. Therefore, in the case of CMP, slurry introduced onto the substrates should be thoroughly removed at the conclusion of polishing in order to obtain a high yield of working devices on the polished substrates.

SUMMARY

In one aspect, the invention is directed to a carrier head that has a retaining ring and a flexible membrane to press a substrate against a polishing surface. The flexible membrane having a roughened lower surface.

Implementations of the invention may include one or more of the following features. The flexible membrane may be sufficiently rough or have a sufficiently high friction coefficient that the substrate does not move or rotate relative to the membrane. The flexible membrane may be formed of a material having a high friction coefficient. The flexible membrane includes features such as grooves or vias to increase its friction coefficient.

In another aspect, the invention is directed to a carrier head that has a retaining ring and a flexible membrane to press a substrate against a polishing surface. The flexible membrane formed of a material having a high friction coefficient.

Implementations of the invention may include one or more of the following features. The flexible membrane may have a rough lower surface. The flexible membrane may include features to increase its friction coefficient.

In another aspect, the invention is directed to a carrier head that has a retaining ring and a flexible membrane to press a substrate against a polishing surface. The flexible membrane including features to increase its friction coefficient.

Implementations of the invention may include one or more of the following features. The flexible membrane may be formed of a material having a high friction coefficient. The bottom of the flexible membrane may be roughened to increase its friction coefficient. The friction coefficient of the flexible membrane may be sufficiently high so that the substrate does not move or rotate relative to the membrane. The features may be grooves or vias.

In another aspect, the invention is directed to a method of assembling a carrier head. In the method, a flexible membrane is abraded to provide the membrane with a roughened surface, and the flexible membrane is installed in the carrier head in a position to apply pressure to a substrate.

Potential advantages of the invention include one or more of the following. Compaction of slurry on the substrate bevel can be reduced, thereby permitting a cleaning system (such as a brush scrubber) to more thoroughly remove the slurry from the substrate and increasing substrate cleanliness. In addition, substrate deformation, such as bowing, can be reduced, thereby improving polishing uniformity.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

As previously noted, it is desirable to achieve a uniform polishing rate across the substrate surface during chemical mechanical polishing and to thoroughly remove slurry from substrate after polishing. It may be possible to achieve these goals by providing a substrate-holding membrane in the carrier head with a roughened surface. The roughened surface can increase the frictional force between the membrane and the backside of the substrate, so that the substrate does not move or rotate relative to the membrane. This can prevent or reduce contact between the substrate the retaining ring, thereby reducing compaction of slurry on the substrate bevel and reducing substrate deformation.

Figure 1:
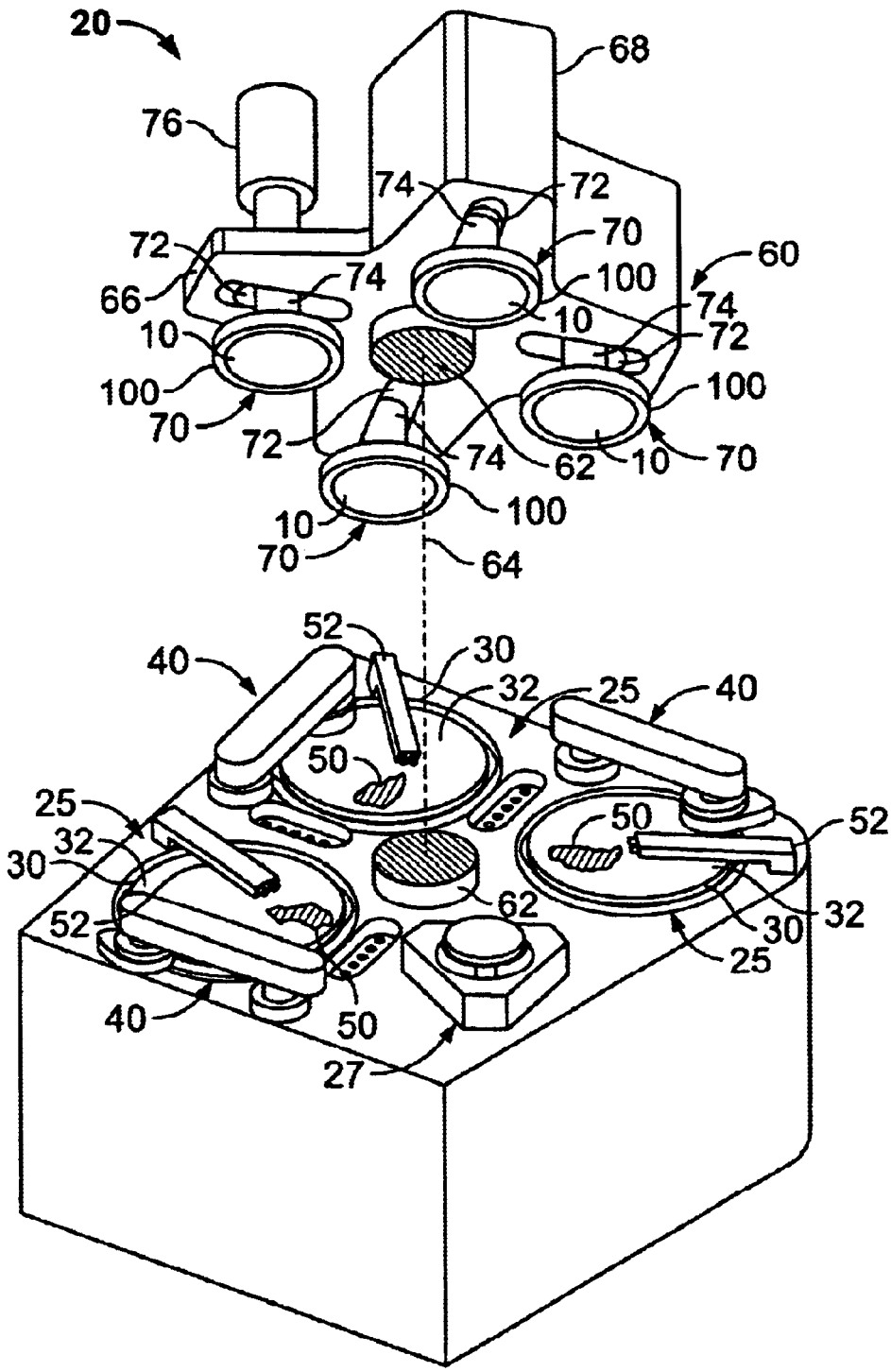
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. Each polishing station 25 may further include an associated pad conditioner apparatus 40 to maintain the abrasive condition of the polishing pad.

A slurry 50 containing a liquid (e.g., deionized water for oxide polishing) and a pH adjuster (e.g., potassium hydroxide for oxide polishing) may be supplied to the surface of the polishing pad 32 by a combined slurry/rinse arm 52. If the polishing pad 32 is a standard pad, the slurry 50 may also include abrasive particles (e.g., silicon dioxide for oxide polishing). On the other hand, if the polishing pad 32 is a fixed-abrasive pad, the slurry 50 may be an abrasiveless fluid. Typically, sufficient slurry is provided to cover and wet the entire polishing pad 32. The slurry/rinse arm 52 includes several spray nozzles (not shown) to provide a high pressure rinse of the polishing pad 32 at the end of each polishing and conditioning cycle.

A rotatable multi-head carousel 60 is supported by a center post 62 and rotated thereon about a carousel axis 64 by a carousel motor assembly (not shown). The multi-head carousel 60 includes four carrier head systems 70 mounted on a carousel support plate 66 at equal angular intervals about the carousel axis 64. Three of the carrier head systems position substrates over the polishing stations, and one of the carrier head systems receives a substrate from and delivers the substrate to the transfer station. The carousel motor may orbit the carrier head systems, and the substrates attached thereto, about the carousel axis between the polishing stations and the transfer station.

Each carrier head system 70 includes a polishing or carrier head 100. Each carrier head 100 independently rotates about its own axis, and independently laterally oscillates in a radial slot 72 formed in the carousel support plate 66. A carrier drive shaft 74 extends through the slot 72 to connect a carrier head rotation motor 76 (shown by the removal of one-quarter of a carousel cover 68) to the carrier head 100. Each motor and drive shaft may be supported on a slider (not shown) which can be linearly driven along the slot by a radial drive motor to laterally oscillate the carrier head 100.

During actual polishing, three of the carrier heads are positioned at and above the three polishing stations. Each carrier head 100 lowers a substrate into contact with the polishing pad 32. The carrier head 100 holds the substrate in position against the polishing pad and distributes a force across the back surface of the substrate. The carrier head 100 also transfers torque from the drive shaft 74 to the substrate.

Figure 2:
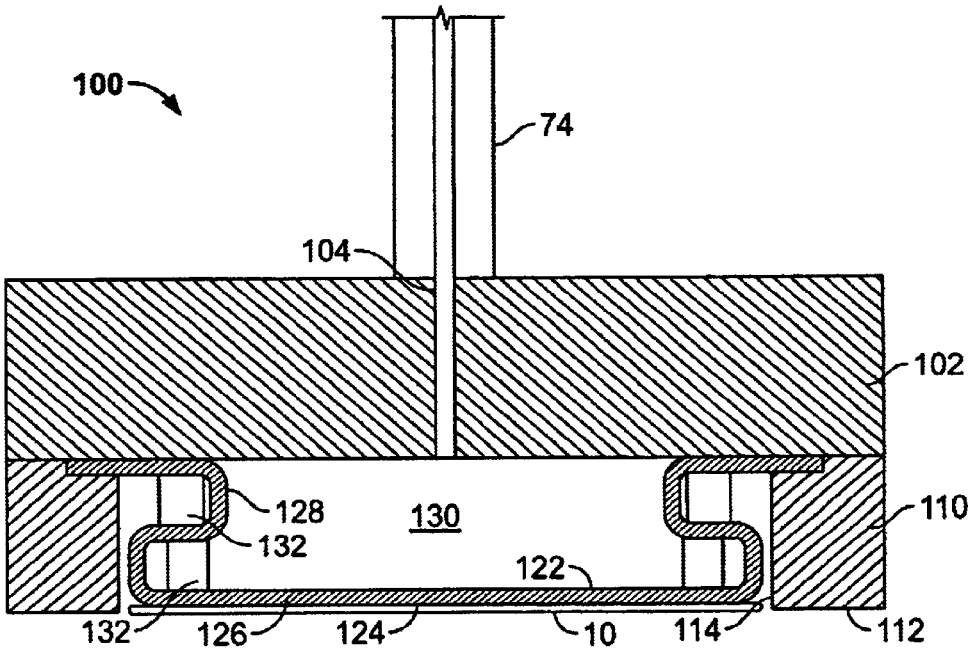
FIG. 2 is a schematic cross-sectional view of a carrier head according to the present invention.

Referring to FIG. 2, the carrier head 100 includes a housing 102, a retaining ring 110, and a substrate backing assembly 120 which includes a flexible membrane 122. The volume between the flexible membrane and the housing can define a pressurizable chamber 130. Although unillustrated, the substrate backing assembly can be suspended from a base assembly (rather than the housing), and the base assembly can be connected to the housing by a separate loading chamber that controls the pressure of the retaining ring on the polishing surface. In this case, the volume between the flexible membrane and the base assembly defines the pressurizable chamber 130. In addition, the carrier head can also include other features, such as a gimbal mechanism (which may be considered part of the base assembly), multiple chambers, and multiple flexible membranes. A description of a similar carrier head with these features may be found in U.S. patent application Ser. No. 09/470,820, filed Dec. 23, 1999, and Ser. No. 09/535,575, filed Mar. 27, 2000, the entire disclosures of which are incorporated herein by reference.

The housing 102 can be connected to the drive shaft 74 (see FIG. 1) to rotate therewith during polishing about an axis of rotation which is substantially perpendicular to the surface of the polishing pad. The housing 102 may be generally circular in shape to correspond to the circular configuration of the substrate to be polished. A passage 104 can extend through the housing 102 for pneumatic control of the chamber 130. If the substrate backing assembly is suspended from a base assembly by a loading chamber, a passage through the housing can be used to control the pressure in the loading chamber, and passages in the base assembly can be connected to the passages in the housing by flexible tubing that extends through the loading chamber.

The retaining ring 110 may be a generally annular ring secured at the outer edge of the housing 102. A bottom surface 112 of the retaining ring 110 may be substantially flat, or it may have a plurality of channels to facilitate transport of slurry from outside the retaining ring to the substrate. If necessary, an inner surface 114 of the retaining ring 110 engages the substrate to prevent it from escaping from beneath the carrier head. If fluid is pumped into the unillustrated loading chamber and the base assembly is pushed downwardly, the retaining ring 110 is also pushed downwardly to apply a load to the polishing pad 32.

The edge of the flexible membrane 122 may be clamped between the housing 102 and the retaining ring 110 to form a fluid-tight seal around chamber 130. One or more membrane spacer rings 132 may be used to hold a perimeter portion 128 of the flexible membrane in a desired shape. The membrane spacer rings may have other shapes selected to affect the distribution of pressure at the substrate edge. A lower surface 124 of a central portion 126 of the flexible membrane 122 provides a substrate-mounting surface. By pressurizing chamber 130, a downward pressure can be applied to the substrate to load it against the polishing pad 32.

The lower surface 124 of the membrane 122 is provided with a fairly high co-efficient of friction, typically greater than the co-efficient of friction of conventional membranes. Specifically, the flexible membrane 122 can have a roughened lower surface 124. For example, one surface of the membrane 122 can be abraded, e.g., with sandpaper, to roughen it prior to installation of the membrane in the carrier head. Alternatively, the membrane 122 can be pre-molded with a rough lower surface. Also, features, such as grooves or vias, can be formed in the membrane (e.g., by premolding the membrane or by cutting portions from the membrane) to increase the friction coefficient. Furthermore, the membrane can be formed of a material, e.g., silicon, that has a high friction coefficient.

Figure 3:
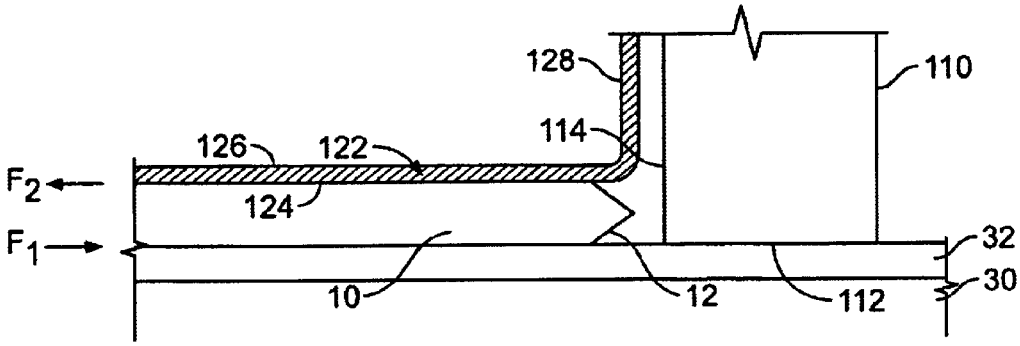
FIG. 3 is a schematic cross-sectional view of a portion of a carrier head showing the interaction among the substrate, membrane, and retaining ring during polishing.

Referring to FIG. 3, during chemical mechanical polishing, the motion of the polishing pad 32 relative to the substrate (e.g., rotation of the polishing pad) generates a frictional force (F1) on the substrate. Additional frictional forces can be generated by substrate rotation and radial translation of the substrate. This first frictional force (F1) tends to drive the substrate against the inner surface 114 of the retaining ring.

The contact between the substrate and the lower surface of the membrane generates a second frictional force (F2) on the substrate which tends to counteract or oppose the first frictional force F1. Since conventional membranes have a smooth surface, F2 is typically less than F1. As a result, the substrate is free to move and the bevel edge 12 of the substrate 10 will contact the inner surface 114 of the retaining ring 110. During polishing, slurry can be trapped into the gap between the substrate and the retaining ring 110. The pressure from the substrate can cause this residual slurry to become compacted on the bevel edge of the substrate. The compacted slurry can be difficult to remove during post-CMP cleaning. In addition, the force of the substrate edge against the retaining ring may cause the substrate to warp or deform.

In contrast, in carrier head 100, the rough surface of the membrane 122 can increase the friction coefficient and the frictional force F2. Specifically, the friction coefficient of the flexible membrane may be sufficiently high that the substrate does not move or rotate relative to the membrane. By increasing the frictional force F2, and by maintaining the membrane in a position away from the inner surface of the retaining ring, the pressure or contact between the substrate and the retaining ring can be reduced during polishing. The reduced pressure or contact can result in less slurry compaction, making it easier for post-CMP cleaners, such as brush scrubbers, to remove residual slurry that remains on the substrate after polishing. In addition, the reduced pressure or contact between the substrate edge and the retaining ring can reduce substrate deformation, thereby improving polishing uniformity.

By increasing the friction coefficient of the bottom surface of the membrane so that F2 is close to F1, the pressure or contact between the substrate and the retaining ring can be reduced. Increasing the friction coefficient so that F2 is equal to or greater than F1 might prevent pressure or contact between the substrate and retaining entirely, thereby substantially eliminating slurry compaction.

A number of implementations of the invention have been described. Nevertheless, it will be understood that various modifications may be made without departing from the spirit and scope of the invention. Accordingly, other implementations are within the scope of the following claims.

What is claimed is:

1. A carrier head, comprising:

a retaining ring;

a pressurizable chamber, and a flexible membrane to press a substrate against a polishing surface, the flexible membrane including an inner surface that forms a boundary of the pressurizable chamber and an outer surface having surface features to increase a friction coefficient of the outer surface, wherein the outer surface is rougher than the inner surface, wherein the outer surface of the flexible membrane is roughened to increase its friction coefficient.

2. A carrier head, comprising:

a retaining ring;

a pressurizable chamber; and a flexible membrane to press a substrate against a polishing surface, the flexible membrane including an inner surface that forms a boundary of the pressurizable chamber and an outer surface having surface features to increase a friction coefficient of the outer surface, wherein the outer surface is rougher than the inner surface, wherein the features are grooves.

3. A carrier head, comprising:

a retaining ring;

a pressurizable chamber; and a flexible membrane to press a substrate against a polishing surface, the flexible membrane including an inner surface that forms a boundary of the pressurizable chamber and an outer surface having surface features to increase a friction coefficient of the outer surface, wherein the outer surface is rougher than the inner surface, wherein the features are vias.

4. A carrier head, comprising:

a retaining ring;

a pressurizable chamber; and a fluid-tight flexible membrane with an ic surface that forms a boundary of the pressurizable chamber and a rough outer surface to press a substrate against a polishing surface, wherein the outer surface is rougher than the inner surface, wherein the outer surface of the flexible membrane includes features to increase its friction coefficient and wherein the features are selected from grooves and vias.

* * * * *